US005814768A

United States Patent [19]

Wessels et al.

[11] Patent Number: 5,814,768

[45] Date of Patent: Sep. 29, 1998

[54] TWISTED PAIRS COMMUNICATIONS CABLE

[75] Inventors: Rob Wessels, Hickory, N.C.; Trent Hayes, Suwanee, Ga.

[73] Assignee: Commscope, Inc., Catawba, N.C.

[21] Appl. No.: 761,981

[22] Filed: Dec. 11, 1996

Related U.S. Application Data

[60] Provisional application No. 60/053,007 filed May 20, 1998.

[51] Int. Cl.[6] ..... H01B 11/02

[52] U.S. Cl. ..... 174/110 FC; 174/113 R; 174/121 A

[58] Field of Search ..... 174/27, 113 R, 174/107, 121 A, 34, 110 FC

[56] References Cited

U.S. PATENT DOCUMENTS

| | | | |
|---|---|---|---|
| 3,571,490 | 3/1971 | Bunish et al. | 174/113 R |
| 3,939,299 | 2/1976 | Raw et al. | 174/23 R |
| 3,985,951 | 10/1976 | Harris | 174/138 F |
| 4,058,669 | 11/1977 | Nutt et al. | 219/121.73 |
| 4,174,236 | 11/1979 | Dougherty et al. | 156/51 |
| 4,220,807 | 9/1980 | Anastasi et al. | 174/36 |
| 4,304,713 | 12/1981 | Perelman | 264/45.9 |
| 4,368,350 | 1/1983 | Perelman | 174/102 D |
| 4,379,858 | 4/1983 | Suzuki | 521/54 |
| 4,412,094 | 10/1983 | Dougherty et al. | 174/110 F |
| 4,423,282 | 12/1983 | Suzuki et al. | 174/36 |
| 4,442,515 | 4/1984 | Meitzler | 367/197 |
| 4,604,497 | 8/1986 | Bell et al. | 174/110 F |
| 4,701,576 | 10/1987 | Wada et al. | 174/117 F |
| 4,711,811 | 12/1987 | Randa | 428/383 |
| 4,730,088 | 3/1988 | Suzuki | 174/102 R |
| 4,789,589 | 12/1988 | Baxter | 428/317.5 |
| 4,894,488 | 1/1990 | Gupta | 174/28 |
| 4,970,112 | 11/1990 | Hayami | 428/314.4 |
| 5,089,329 | 2/1992 | de Vrieze et al | 428/313.5 |
| 5,110,998 | 5/1992 | Muschiatti | 174/24 |
| 5,132,488 | 7/1992 | Tessier et al. | 174/34 |
| 5,187,329 | 2/1993 | Bleich et al. | 174/113 R |
| 5,192,834 | 3/1993 | Yamanishi et al. | 174/120 SR |
| 5,198,621 | 3/1993 | Kojima | 174/128.1 |
| 5,239,813 | 8/1993 | Baumgarten | 57/12 |
| 5,253,317 | 10/1993 | Allen et al. | 385/109 |
| 5,283,390 | 2/1994 | Hubis et al. | 174/36 |
| 5,298,680 | 3/1994 | Kenny | 174/36 |
| 5,314,712 | 5/1994 | Bleich et al. | 174/113 R X |
| 5,399,813 | 3/1995 | McNeill et al. | 174/117 F |

(List continued on next page.)

FOREIGN PATENT DOCUMENTS

| | | |
|---|---|---|
| 53-145085 | 12/1978 | Japan . |
| 792338 | 3/1958 | United Kingdom . |
| 1169797 | 2/1967 | United Kingdom . |
| 2069819 | 10/1982 | United Kingdom . |

*Primary Examiner*—Bot L. Ledynh
*Assistant Examiner*—Marc Machtinger
*Attorney, Agent, or Firm*—Bell Seltzer Intellectual Property Group of Alston & Bird LLP

[57] ABSTRACT

There is disclosed a communications cable having a cable jacket and a first pair of twisted wires disposed within the jacket, each wire thereof having a conductor surrounded by a first insulating material. A second twisted pair of wires is disposed within the jacket and has a twist lay length different from that of the first twisted pair. Each wire of the second twisted pair has a conductor surrounded by an insulating material. The insulating material of the first twisted pair differs in a physical property from the insulating material of the second twisted pair, the physical property of the insulating material of the second pair being correlated with the physical property of the insulating material of the first twisted pair and with differences in twist lay length of the first and second twisted pairs so that the phase delay of the twisted pairs is matched. There is also provided a communications cable having more than two twisted pairs. The insulating materials include polyolefins such as polyethylene, and fluorinated polymers such as fluorinated ethylene-propylene. The insulating material may be used as either a solid or foamed material covering the conductor. These insulated wires may be used in the transmission of electronic signals in a plenum-rated communications cable.

19 Claims, 2 Drawing Sheets

U.S. PATENT DOCUMENTS

| | | | |
|---|---|---|---|
| 5,438,571 | 8/1995 | Albrecht et al. | 370/408 |
| 5,441,813 | 8/1995 | Sano et al. | 428/375 |
| 5,462,803 | 10/1995 | Wessels | 428/380 |
| 5,469,523 | 11/1995 | Blew et al. | 385/101 |
| 5,493,071 | 2/1996 | Newmoyer | 174/113 R |
| 5,514,837 | 5/1996 | Kenny et al. | 174/113 R |
| 5,614,319 | 3/1997 | Wessels et al. | 428/379 |
| 5,619,016 | 4/1997 | Newmoyer | 174/113 R |

TWISTED PAIRS COMMUNICATIONS CABLE

CROSS-REFERENCE TO RELATED APPLICATION

This application claims priority from provisional application Ser. No. 60/053,007 for which a Petition To Convert Application To Provisional Application (submitted on Nov. 20, 1996) from application Ser. No. 08/656,714, filed Jun. 3, 1996, for TWISTED PAIRS COMMUNICATIONS CABLE AND METHOD OF MAKING SAME which are hereby incorporated herein by reference.

BACKGROUND OF THE INVENTION

This invention relates to a cable made of twisted wire pairs. More particularly, this invention relates to a twisted pair communications cable designed for use in high speed data communications applications.

A twisted pair cable includes at least one pair of insulated conductors twisted about each other to form a two conductor group. When more than one twisted pair group is bunched or cabled together, it is referred to as a multi-pair cable. In certain communications applications using a multi-pair cable, such as in high speed data transmission for example, problems are encountered if the signal transmitted in one twisted pair arrives at its destination at a different time than the signal in another twisted pair in the cable. This phenomenon, known as "phase delay skew", results from differences in the propagation of the signal along different pairs in the cable and may cause transmission errors.

SUMMARY OF THE INVENTION

The present invention recognizes that there are various factors which may contribute to differences in signal propagation along different twisted pairs in a communications cable. These factors may include, for example, the degree of twist or "lay length" of the pair, the cable geometry, the chemical composition of the insulating material of each pair, the thickness of the insulation, thickness of each layer of insulation in multi-layer insulation systems, or the density of the insulating material. In the cable manufacturing process, one or more of these factors may produce differences in physical properties among the various twisted pairs of the cable. For example, each twisted pair may have a different twist or lay length from the other pairs of the cable, or different pairs may use different insulating materials, or different thicknesses or densities of insulation.

In accordance with the present invention, these differences in physical properties among the respective pairs are recognized, and those factors affecting signal propagation are taken into account and correlated so that the signal propagation characteristics of the respective pairs of the cable are matched.

The signal propagation characteristics of a twisted pair can be determined from standard test methods using readily available instrumentation, such as a network analyzer. Phase delay is a measure of the amount of time a simple sinusoidal signal is delayed when propagating through the length of a pair. Skew is defined as the difference in the phase delay value of two different twisted pairs in a cable. In a cable containing more than two twisted pairs, the skew value is represented by the maximum difference in phase delay between any two pairs of the cable.

According to the present invention, the phase delay characteristic of a twisted pair in the cable is matched with the phase delay characteristic of at least one other twisted pair of the cable to substantially eliminate skew. The term "matched" as used herein, is intended to encompass differences in phase delay of from 0 to 10 nanoseconds per 100 meters of length. This matching of the phase delay characteristic is achieved by correlating a physical property of the insulating material of one or more of the twisted pairs with those factors in the other twisted pairs which produce differences in phase delay. Thus, for example, the chemical composition, thickness or density of the insulating material of one twisted pair may be controllably altered relative to another twisted pair so as to bring about a matching of the phase delay. According to one preferred aspect of the present invention, this may be done by controlled foaming of the insulating material of one or more of the pairs, as for example, by controlled addition of a chemical or gas blowing agent to the insulating material polymer as it is applied to the electrical conductor.

By way of example, a communications cable in accordance with the present invention may have a cable jacket and a first twisted pair of wires disposed within the jacket. Each wire of the first twisted pair of wires has a conductor surrounded by an insulating material. A second twisted pair of wires is also disposed within the jacket. The second twisted pair of wires has a twist lay length different from that of the first twisted pair. Each wire of the second twisted pair has a conductor surrounded by an insulating material. The insulating material of the first twisted pair differs in a physical property from the insulating material of the second twisted pair, and the physical property of the insulating material of this second twisted pair is correlated with the physical property of the insulating material of the first twisted pair and with the difference in twist lay length of the first and second twisted pairs so that the phase delay of each twisted pair is matched.

Also in accordance with the present invention there is provided a communications cable having a cable jacket and a first pair of twisted wires disposed within the jacket. Each wire of the twisted pair has a conductor surrounded by a first insulating material. Second, third and fourth twisted pairs of wires are also disposed within the jacket. Each wire of the second, third and fourth twisted pairs has a conductor surrounded by an insulating material. The second, third and fourth twisted pairs each have a twist lay length different from that of the first twisted pair. The insulating material of each of the second, third and fourth twisted pairs differs in a physical property from the insulating materials of each of the other twisted pairs in the cable. The physical property of the insulating material of each pair is correlated with the physical properties of the insulating material of all the other twisted pairs and with the difference in twist lay length of all the other twisted pairs so that the phase delay of each of the first, second, third and fourth twisted pairs is matched.

Cables in accordance with the present invention may be engineered to meet the stringent electrical specifications of high speed data communications, such as Category 5 cables, and also to meet the stringent fire and smoke specifications required for use in plenums. For plenum cables, one or more of the conductors may have its insulating material made of fluorinated polymer selected from the group consisting of fluorinated ethylene-propylene, ethylene-trifluoroethylene and ethylene-chlorotrifluoroethylene. Other pairs in the cable may use a polyolefin insulating material, preferably an unmodified polyethylene.

BRIEF DESCRIPTION OF THE DRAWINGS

Other features and advantages of the present invention will become apparent from the detailed description of the invention which follows, and from the accompanying drawings, in which.

DETAILED DESCRIPTION OF THE PREFERRED EMBODIMENTS

Figure 1:
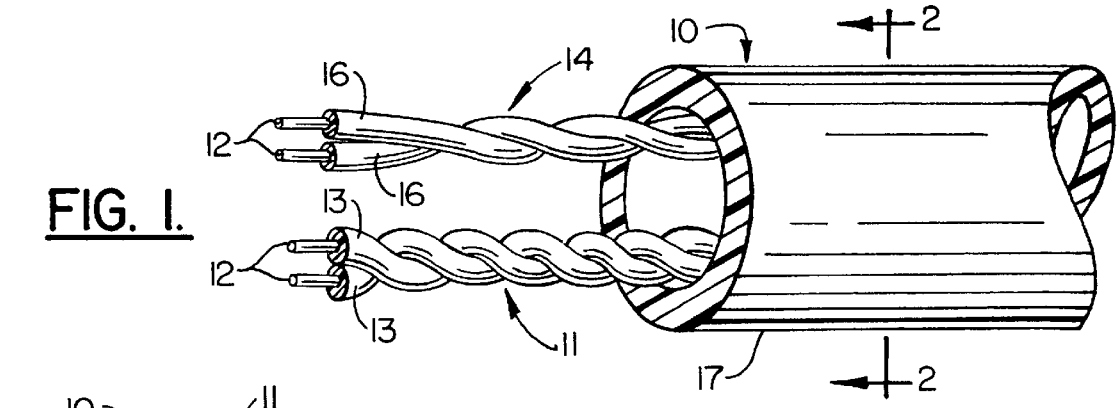
FIG. 1 is a perspective view of a cable according to one embodiment of this invention, wherein the cable has two twisted conductor pairs.
Figure 2:
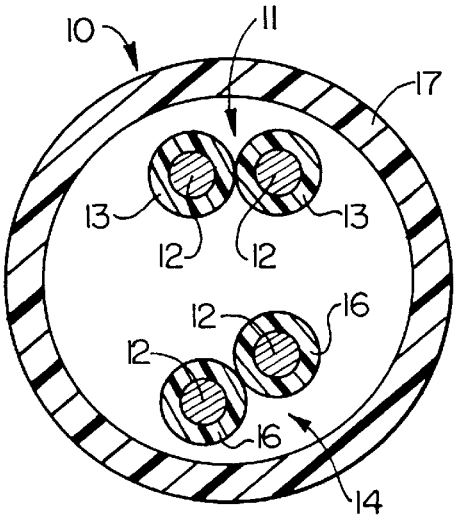
FIG. 2 is a cross-sectional view of the cable of FIG. 1 taken along line 2—2 of FIG. 1.

Referring now to FIG. 1, there is shown a communications cable designated generally by 10 having two pairs of twisted wires disposed within a cable jacket 17. A first twisted pair of wires 11 is comprised of conductors 12 each surrounded by a first insulating material 13. The second twisted pair of wires 14 comprises conductors 12 surrounded by a second insulating material 16. The second twisted pair 14 has a lower degree of twist, i.e. a longer twist lay length, than that of the first twisted pair 11. The insulating material of the first twisted pair 11 differs in a physical property from the insulating material of the second twisted pair 14. The physical property of the insulating material of the second pair 14 is correlated with the physical property of the insulating material of the first twisted pair 11 and with the difference in twist lay length of the first and second twisted pairs so that the phase delay of the first and second twisted pairs is matched. The physical properties of the insulting material which may be controllably altered to match the phase delay of the twisted pairs may include one or more of the following: chemical composition of the polymeric material forming the insulating material, chemical additives in the insulating material composition, thickness of the insulating material, or density of the insulating material.

A difference in the twist lay length of the twisted pairs 11 and 14 will result in differences in the distance that the signals must travel in the respective pairs over a given length of cable, and will thus contribute to a difference in phase delay or "skew". However, the phase delay can be matched by appropriately controlling the physical properties of the insulating materials of the two pairs. For example, the amount of skew contributed by the difference in twist lay length can be determined empirically or by calculation, and can be compensated for by selecting insulating material for pair 11 with an appropriately lower dielectric constant than the dielectric constant of the insulating material used in pair 14. The dielectric constant of an insulating material affects the velocity at which the signals propagate along the insulated conductor. The dielectric constant (K) of an insulating material may be determined by standard test methods, such as ASTM test method D-150.

The conductors 12 may be a wire of any of the well-known electrically conductive materials used in wire and cable applications, such as copper, aluminum, copper-clad steel or plated copper. The wire is preferably 18 to 26 AWG gauge. The insulating materials 13, 16 may be an extruded polymer layer, which may be formed as a solid or a foam. Any of the polymers conventional used in wire and cable manufacture can be employed. Where the cable is to be used in applications requiring good flame resistance and low smoke generation, it may be desirable to use a fluorinated polymer as the insulating material for one or more of the pairs. Members of this group include fluorinated ethylene-propylene (FEP), ethylene-trifluoroethylene (ETFE) or ethylene-chlorotrifluoroethylene (ECTFE). A preferred fluorinated polymer is fluorinated ethylene-propylene. Another particularly suitable fluorinated copolymer is HALAR® fluorinated copolymer available from Allied Chemical Corp. Other pairs in the cable may use a polyolefin insulating material, such as polyethylene or polypropylene. The polyolefin is preferably unmodified, i.e., does not include a flame retardant. Preferably, the polyethylene may be selected from the group consisting of low density polyethylene, medium density polyethylene, high density polyethylene, ethylene-propylene rubber and linear low density polyethylene. One preferred polyethylene is available from Union Carbide and is designated 3485. In one aspect of this invention a polyolefin and a fluorinated polymer may be mixed to form one of the insulating materials. Preferably, the polyolefin in the mixture is polyethylene and is present in an amount from 3.0% to 50% by weight of the total mixture. The remainder of the mixture is preferably ethylene-chlorotrifluoroethylene (ECTFE). Especially preferred for communications cable is an amount of polyolefin from about 10% by weight to about 30% by weight of the total mixture.

The assembly of multi-pairs of twisted wires and shield, if present, is referred to as a cable core. A suitable jacket 17 is applied over the cable core. The jacket may be a polymer of fluoropolymer, polyvinylchloride, or a polyvinylchloride alloy suitable for communications cable use.

Figure 3:
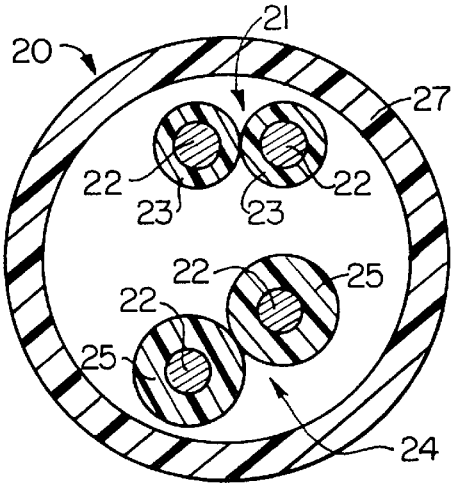
FIG. 3 is a cross-sectional view of a cable similar to that of FIG. 2, but wherein one pair has a solid insulating material and the other pair has a foamed insulating material.

Referring now to FIG. 3, there is shown another embodiment of a communications cable made according to this invention designated generally by 20 having two pairs of twisted wires. A first pair of twisted wires 21 is comprised of conductors 22 each surrounded by a first insulating material 23. The other pair of twisted wires 24 comprises conductors 22 and are surrounded by a foamed insulating material 25. The two pairs of twisted wires may be enclosed in an insulating jacket 27 to form the multi-paired cable 20.

The insulating material 23, 25 may be selected from the polyolefins and fluorinated polymers discussed above. When the insulating composition is to be foamed, a blowing agent is added during processing. The blowing agent may be any suitable physical or chemical blowing agent which promotes foam formation of the composition. Physical blowing agents, such as volatile liquids or gases are typically added during the extrusion process, while the mixture is in the molten state. Chemical blowing agents are typically blended with the insulating material during the compounding process. Chemical blowing agents include, but are not limited to, hydrozodicarboxylates, 5-phenyl tetrazole, diesters of azodiformic acid and carbazides. Especially preferred is azodicarbonamide. The chemical blowing agents may be self-nucleating. The blowing agent is added to the insulating material in an effective amount sufficient to cause cells to form within the mixture. There can be from about 0.05% to about 1.0% by weight of chemical blowing agent present in the mixture. Preferably, there is from about 0.1% to about 0.5% by weight. Gas blowing agents which may be selected include, but are not limited to, nitrogen, carbon dioxide, chlorodifluoromethane (F22) or any gas mixture that is soluble in the molten mixture.

By appropriately controlling the foaming conditions, including the extrusion temperature and the type and amount of blowing agent, the density of the foamed insulating material can be controlled. Since the dielectric constant of the insulating material is a function of the composition of the insulation material and its density, the dielectric constant of the insulating material is lowered as the degree of foaming or expansion is increased.

To ensure that a uniform, small diameter cell structure is present in foam structures, a nucleating agent may be provided. The nucleating agent also provides sites for the formation of cells generated by the blowing agent. Thus, an effective amount of nucleating agent is an amount sufficient to ensure proper cell formation. There can be up to 10 parts by weight of nucleating agent, preferably from about 0.1 to 3 parts of nucleating agent per 100 parts of mixture. The nucleating agent may be selected from a group of known nucleators including, but not limited to, boron nitride, polytetrafluoroethylene, talc, calcium carbonate, barium carbonate, zinc carbonate, lead carbonate, and oxides of lead, magnesium, calcium, barium and zinc.

Other additives may be used to enhance the flame retardancy, material compatibility and processing of the mixture. Useful flame retardants include, by way of example, antimony oxide. Compatibilizers include KRATON® rubber (a thermoplastic elastomer from Shell Chemical Co.) and ethylene-propylene rubber, for example. The insulating composition may also optionally contain suitable additives, such as pigments, antioxidants, thermal stabilizers, acid acceptors and processing aids. When, as is preferred, the composition is electrically insulating, any conductive fillers which are present should be used in small amounts which do not render the composition conductive.

Figure 4:
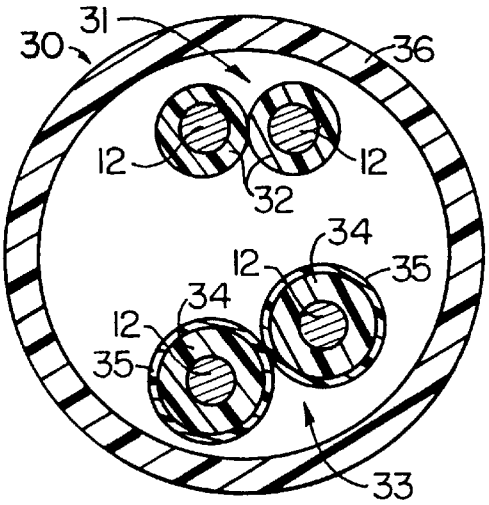
FIG. 4 is a cross-sectional view of a cable similar to that of FIG. 2, but wherein one pair has a solid insulating material and the other pair has a foamed insulating material with a skin surrounding the foam layer.

Turning now to FIG. 4, there is shown another embodiment of the present invention, a cable 30 having a two twisted pairs 31, 33 generally similar to those shown in FIG. 3. Twisted pair 31 has a conductor 12 and an insulating layer 32 of an unfoamed FEP polymer. The second pair of twisted wires 33 has conductors 12 and a foamed polyethylene insulating material 34 surrounding the conductors. The insulating material is surrounded by an outer skin layer 35 of unfoamed polymer in contact with insulating material 34. The skin layer is a layer of an abrasion resistant and/or flame-resistant polymer, preferably, unfoamed polyethylene at a thickness of 0.002". One preferred polyethylene for the skin layer is a mineral filled polyethylene designated 0241 from Alpha-Gary. Another preferred insulated wire is a combination of unmodified polyethylene foam with an unmodified high density polyethylene skin. One preferred polyethylene for the skin layer is Union Carbide 3364. As another example the insulating layer may be a foamed fluorinated ethylene-propylene (FEP) and a skin layer of unfoamed fluorinated ethylene-propylene (FEP).

Figure 5:
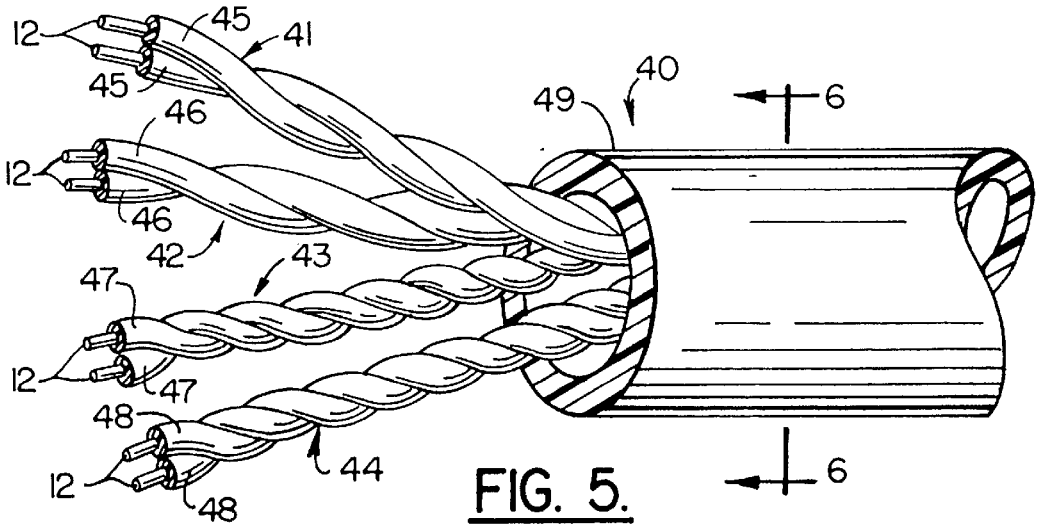
FIG. 5 is a perspective view of a cable according to another embodiment of this invention, wherein the cable has four twisted pairs.
Figure 6:
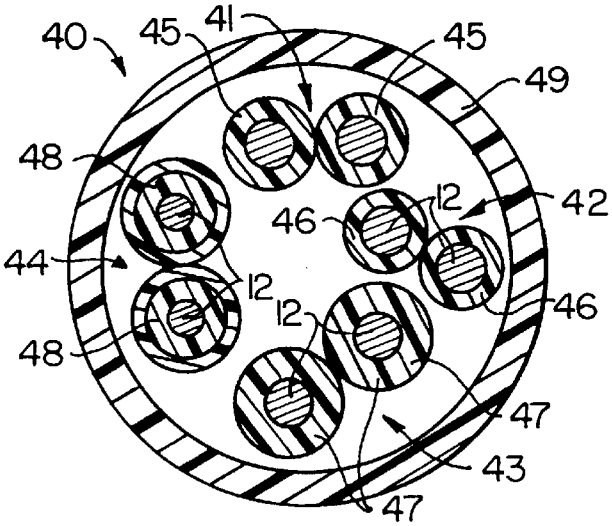
FIG. 6 is cross-sectional view of a cable taken along the line 6—6 of FIG. 5, illustrating four twisted pairs of wires, wherein two pairs have a solid insulating material, one pair has a foamed insulating material and one pair has a foam-skin insulating material.

Another embodiment of the communications cable is shown in FIGS. 5–6 wherein there is provided a communications cable 40 having four pairs of twisted wires 41, 42, 43, and 44. Each wire of the pairs of twisted wires is comprised of conductors 12 each surrounded by an insulating material. The insulating materials may be selected from those described above. The insulating material 45, 46, 47 and 48 may be and preferably is different from at least one of the other pairs. For example, the insulating material 45 for twisted pair 41 may be a solid polymer, while the insulating material 46 for twisted pair 42 may be a different polymer and the insulating materials 47, 48 for pairs 43, 44 may be a foamed polymer. The foamed pairs may be the same insulating material foamed to a different degree. One or more of the pairs may have an insulating material of a foam-skin construction as previously described. The pairs of twisted wires may be enclosed in an insulating jacket 49 to form the multi-paired cable 40.

The wires forming the foamed twisted pairs are made by covering the individual conductors with a layer of insulating material. The insulating material is prepared by compounding the insulating material polymer with an effective amount of a chemical blowing agent until they are blended. The blended insulating material is heated in an extruder to a predetermined temperature above the melt point of the insulating material under sufficient pressure to cause foam when the mixture is released. The predetermined temperature of the material will have a dielectric constant correlated with that of a first insulating material. The melt processible insulating material may be applied to a metal conductor wire via an extrusion process. When the material leaves the extrusion chamber the pressure is released forming a foamed insulating conductive element.

The insulation should be about 5 to about 80 mils in thickness, preferably 8 mils to 50 mils for either solid or foam insulation. When the insulation is foamed, the void content of the foam may range from 10% to 60%. A void content of 30% to 45% is preferable. The foamed insulating material has a lower dielectric constant than the solid material.

Several examples are set forth below to illustrate the nature of the invention and the manner in which it is carried out. However, the invention should not be considered as being limited to the details thereof.

EXAMPLE 1

For this example four pairs of twisted wires were constructed. Two pairs of twisted wires were constructed using a solid FEP insulation. The other two pairs were constructed of a polyethylene foam made by extruding a pre-compounded polyethylene containing 0.1% by weight of azodicarbonamide as the blowing agent and heating at about 350° F. prior to extruding at a thickness of 5 mil. The extrusion also included a polyethylene skin having a thickness of 2 mil. The capacitance and diameter of the polyethylene foam pairs were controlled to match the phase delay of the FEP pairs. The foamed pairs had a greater amount of twist than the solid pairs.

The signal propagation of each pair was tested and a comparison of the phase delay from the different pairs of twisted wires was made. The comparison showed the measured curve fit phase delay skew was 5.1 nanoseconds per 100 meters between the solid pairs and the foamed pairs. This was the worst case from the four pairs.

In contrast, an all FEP insulated cable having the same amount of twist as the foamed pairs measured 11.3 nanoseconds per 100 meters. An all polyethylene cable of the same construction measured 8.9 nanoseconds per 100 meters. The matched dielectric sample had better phase delay skew performance than the cable manufactured from common, solid dielectric materials.

The phase delay measurements were made using the following apparatus:

Hewlett Packard 8753D Network Analyzer

S-parameter test set (2) F to BNC connectors (2) North Hills 0322BF Baluns

HP-IB interface board with interface cable A sample of a 4 pair category 5 cable was prepared by cutting a 100 meter length, removing 1.5 inches of the cable jacket at each end, and removing 0.25 inches of insulation on all conductors for attachment to the Network Analyzer. The Network Analyzer was setup in accordance with ASTM D-4566 39.3 as follows:

Set unit for forward transmission

Format—Delay

Number of measurement points—401

Sweeptime—1s

IF bandwidth—1000 kHz

Linear Scale—0.3 to 100 MHz

Reference—500 ns The baluns were connected to the Network Analyzer via F to BNC connectors and a BNC connectorized patch cable. Each pair was tested separately. Data gathered for each pair includes minimum, maximum, average and standard deviation per ASTM D-4566 40.2.

EXAMPLE 2

For this example, four pairs of twisted wires were constructed. All four pairs of twisted wires were insulated with a foamed polyethylene, similar to that used in Example 1, extruded at a thickness of 5½ mils. The extrusion also included a solid ECTFE skin having a thickness of 2 mils. The capacitance and outer diameter of the insulated wires were controlled to compensate for the different twist lengths for each pair. The wires used in the shortest pair twist has a lower capacitance than those in the longer twist length. All wires had the same diameter over the insulation, but different capacitances.

The signal propagation for each pair was tested per the method illustrated in Example 1. The test showed a curve fit phase delay skew of 3.7 nanoseconds per 100 meters.

While the invention has been described and illustrated herein by references to various specific materials, procedures and examples, it is understood that the invention is not restricted to the particular materials, combinations of materials, and procedures selected for that purpose. Numerous variations of such details can be employed, as will be appreciated by those skilled in the art.

That which is claimed is:

1. A communications cable comprising a cable jacket;

a first pair of twisted wires disposed within said jacket, each wire thereof having a conductor surrounded by a first insulating material; and a second twisted pair of wires disposed within said jacket and having a twist lay length different from that of said first twisted pair, each wire of said second twisted pair having a conductor surrounded by an insulating material;

the insulating material of said first twisted pair differing in a physical property from the insulating material of said second twisted pair, the physical property of the insulating material of said second pair being correlated with said physical property of the insulating material of said first twisted pair and with the difference in twist lay length of said first and second twisted pairs so that the phase delay of said first and second twisted pairs is matched.

2. The communications cable according to claim 1 additionally including third and fourth twisted pairs of wires disposed within said jacket, each wire thereof having a conductor surrounded by an insulating material, and each of said pairs having a twist lay length different from that of all other of said pairs in the cable.

3. The communications cable according to claim 2, wherein the insulating material of said third and fourth pairs differs in a physical property from the insulating material of said first and second pairs.

4. The communications cable according to claim 1 wherein at least one of said insulating materials is a fluorinated polymer selected from the group consisting of fluorinated ethylene-propylene, ethylene-trifluoroethylene and ethylene-chlorotrifluoroethylene.

5. A communications cable comprising a cable jacket;

a first pair of twisted wires disposed within said jacket, each wire thereof having a conductor surrounded by a first insulating material; and second, third and fourth twisted pairs of wires disposed within said jacket, each wire of said second, third and fourth twisted pairs having a conductor surrounded by an insulating material, and said second, third and fourth twisted pairs each having a twist lay length different from that of said first twisted pair;

the insulating material of each of said second, third and fourth twisted pairs differing in a physical property from the insulating materials of each of the other twisted pairs in the cable, the physical property of the insulating material of each said pair being correlated with said physical properties of the insulating material of all other said twisted pairs and with difference in twist lay length of all other said twisted pairs so that the phase delay of said first, second, third and fourth twisted pairs is matched.

6. The communications cable according to claim 5 wherein at least one of said insulating materials is a fluorinated polymer selected from the group consisting of fluorinated ethylene-propylene, ethylene-trifluoroethylene and ethylene-chlorotrifluoroethylene.

7. The communications cable according to claim 6 wherein said at least one insulating material is fluorinated ethylene-propylene.

8. The communications cable according to claim 5 wherein at least one other of said insulating materials is a polyolefin.

9. The communications cable according to claim 6 wherein said polyolefin is selected from the group consisting of high density polyethylene, medium density polyethylene, low density polyethylene, ethylene-propylene rubber, linear low density polyethylene and copolymers of ethylene and alpha olefins.

10. The communications cable according to claim 5 wherein one of said insulating materials is a mixture of a polyolefin and a fluorinated polymer selected from the group consisting of fluorinated ethylene-propylene, ethylene-trifluoroethylene, and ethylene-chlorotrifluoroethylene polymer.

11. The communications cable according to claim 10, wherein said polyolefin is present in an amount from 10% to 30% by weight of the total mixture and the balance is said fluorinated polymer.

12. The communications cable according to claim 5 wherein said insulating material for each of said first, second, third and fourth twisted pairs has a thickness of from about 5 mils to about 80 mils.

13. The communications cable according to claim 5 wherein at least one of said second, third, and fourth twisted pairs has an insulating material surrounded by an outer skin layer in contact with said insulating layer, said skin layer being a layer of an abrasion resistant and flame-resistant polymer.

14. A communications cable comprising a cable jacket;

a first pair of twisted wires disposed within said jacket, each wire thereof having a conductor surrounded by a first insulating material formed of an unmodified polyethylene; and second, third and fourth twisted pairs of wires disposed within said jacket, each wire of said second, third and fourth twisted pairs having a conductor surrounded by an insulating material formed of a fluorinated polymer, and said second, third and fourth twisted pairs each having a twist lay length different from that of said first twisted pair;

the insulating material of said first twisted pair differing in a physical property from the insulating materials of said second, third and fourth twisted pairs, the physical property of the insulating material of said first twisted pair being correlated with the physical properties of the insulating material of said second, third and fourth twisted pairs and with difference in twist lay length of said twisted pairs so that the phase delay of said first twisted pair relative to said second, third and fourth twisted pairs is no more than 10 nanoseconds per 100 meters of length.

15. The communications cable according to claim 14, wherein said first insulating material is foamed.

16. The communications cable according to claim 15, including an unfoamed outer skin layer surrounding said foamed first insulating material.

17. A communications cable comprising a cable jacket;

a first and second pairs of twisted wires disposed within said jacket, each wire thereof having a conductor surrounded by a first insulating material formed of an unmodified polyethylene; and third and fourth twisted pairs of wires disposed within said jacket, each wire of said third and fourth twisted pairs having a conductor surrounded by an insulating material formed of a fluorinated polymer, each of said third and fourth twisted pairs having a twist lay length different from that of said first and second twisted pairs;

the insulating material of said first and second twisted pair differing in a physical property from the insulating materials of said third and fourth twisted pairs, with said physical property of the insulating material of said first and second twisted pairs being correlated with the physical properties of the insulating material of said third and fourth twisted pairs and with the differences in twist lay length of said twisted pairs so that the maximum phase delay of said first and second twisted pairs relative to said third and fourth twisted pairs is no more than 10 nanoseconds per 100 meters of length.

18. The communications cable according to claim 17, wherein said first insulating material is foamed.

19. The communications cable according to claim 18, including an unfoamed outer skin layer surrounding said foamed first insulating material.

* * * * *

UNITED STATES PATENT AND TRADEMARK OFFICE
CERTIFICATE OF CORRECTION

PATENT NO. : 5,814,768

DATED : September 29, 1998

INVENTOR(S) : Wessels et al.

It is certified that error appears in the above-identified patent and that said Letters Patent is hereby corrected as shown below:

Title page, item [60],
In "Related U.S. Application Data," the filing date of "May 20, 1998" should read --June 3, 1996--.

Signed and Sealed this

Sixth Day of April, 1999

*Attest:*

Q. TODD DICKINSON

*Attesting Officer*

*Acting Commissioner of Patents and Trademarks*